US010026386B2

(12) United States Patent
Kira

(10) Patent No.: US 10,026,386 B2
(45) Date of Patent: Jul. 17, 2018

(54) APPARATUS, METHOD AND COMPUTER PROGRAM FOR MEMORIZING TIMBRES

(75) Inventor: Yoshifumi Kira, Hamamatsu (JP)

(73) Assignee: KAWAI MUSICAL INSTRUMENTS MFG. CO., LTD., Hamamatsu (JP)

( * ) Notice: Subject to any disclaimer, the term of this patent is extended or adjusted under 35 U.S.C. 154(b) by 235 days.

(21) Appl. No.: 11/989,944

(22) PCT Filed: Mar. 31, 2006

(86) PCT No.: PCT/JP2006/306888

§ 371 (c)(1),
(2), (4) Date: Feb. 4, 2008

(87) PCT Pub. No.: WO2007/015320

PCT Pub. Date: Feb. 8, 2007

(65) Prior Publication Data

US 2009/0183624 A1 Jul. 23, 2009

(30) Foreign Application Priority Data

Aug. 2, 2005 (JP) ..... 2005-223574

(51) Int. Cl.
*G10H 1/08* (2006.01)
*G10H 1/24* (2006.01)

(52) U.S. Cl.
CPC ..... *G10H 1/24* (2013.01)

(58) Field of Classification Search
USPC ..... 84/622
See application file for complete search history.

(56) References Cited

U.S. PATENT DOCUMENTS 5,125,314 A * 6/1992 Chihana ..... G10H 1/24 84/601
5,177,314 A * 1/1993 Matsuda ..... G10H 1/10 84/615
5,412,153 A * 5/1995 Saito ..... G10H 7/06 84/445
5,712,438 A * 1/1998 Nakata ..... 84/622
(Continued)

FOREIGN PATENT DOCUMENTS

JP A-59-223350 12/1984
JP A-03-123552 5/1991
JP A-03-241052 10/1991
(Continued)

*Primary Examiner* — Christopher Uhlir
(74) *Attorney, Agent, or Firm* — Oliff PLC

(57) ABSTRACT

Some timbres in the timbre combinations are selected and memorized according to the above timbre selection means corresponding to the timbre groups that the selected timbres belong to. The timbre combinations are classified and memorized according to the timbre groups. Thus it is made easy to search a timbre combination. When the store button 27 is turned on (step 61), it is identified which zone is appointed by the zone select buttons 24 being turned on placed on the switch table (step 63) and tone number data in the zone in the setup timbre register 42 are read out (step 64). At the top address of the vacant area in the setup area of the timbre group area on the timbre table 61 corresponding to the selected tone number data, tone number data, loudness data and setup range data of all the zones of the setup timbre register 42 (step 65).

9 Claims, 10 Drawing Sheets

(56) References Cited

U.S. PATENT DOCUMENTS 5,908,997 A * 6/1999 Arnold ..... G09B 15/04
84/478

FOREIGN PATENT DOCUMENTS

| | | |
|---|---|---|
| JP | A-03-269496 | 12/1991 |
| JP | A-05-108070 | 4/1993 |
| JP | A-08-129381 | 5/1996 |
| JP | A-08-302555 | 11/1996 |
| JP | A-09-097073 | 4/1997 |
| JP | A-09-507408 | 7/1997 |
| JP | A-09-288485 | 11/1997 |
| JP | A-09-319370 | 12/1997 |
| JP | A-11-224085 | 8/1999 |
| JP | A-2000-206969 | 7/2000 |
| JP | A-2002-351468 | 12/2002 |
| JP | A-2003-076371 | 3/2003 |
| JP | A-2004-347705 | 12/2004 |
| JP | A-2005-097782 | 4/2005 |
| JP | A-2005-189793 | 7/2005 |
| WO | WO 03/048436 A2 | 6/2003 |

* cited by examiner

FIG. 3

61(4)

| timbre table | | | | | | | | | | |
|---|---|---|---|---|---|---|---|---|---|---|
| | timbre group | | | | | | | | | |
| | piano | electoric piano | drawbar | organ | strings | wind/ brass | pad | bass guitar | | |
| sound area | tone number | tone number | tone number | tone number | tone number | tone number | tone number | tone number | stored area | |
| | tone number | tone number | tone number | tone number | tone number | tone number | tone number | tone number | | |
| | tone number | tone number | tone number | tone number | tone number | tone number | tone number | tone number | | |
| | ..... | ..... | ..... | ..... | ..... | ..... | ..... | ..... | | |
| | ..... | ..... | ..... | ..... | ..... | ..... | ..... | ..... | | |
| | tone number | tone number | tone number | tone number | tone number | tone number | tone number | tone number | vacant area | |
| | tone number | tone number | tone number | tone number | tone number | tone number | tone number | tone number | | |
| | tone number | tone number | tone number | tone number | tone number | tone number | tone number | tone number | | |
| | ..... | ..... | ..... | ..... | ..... | ..... | ..... | ..... | | |
| | ..... | ..... | ..... | ..... | ..... | ..... | ..... | ..... | | |
| setup area | combination | combination | combination | combination | combination | combination | combination | combination | stored area | |
| | combination | combination | combination | combination | combination | combination | combination | combination | | |
| | combination | combination | combination | combination | combination | combination | combination | combination | | |
| | ..... | ..... | ..... | ..... | ..... | ..... | ..... | ..... | | |
| | ..... | ..... | ..... | ..... | ..... | ..... | ..... | ..... | | |
| | combination | combination | combination | combination | combination | combination | combination | combination | vacant area | |
| | combination | combination | combination | combination | combination | combination | combination | combination | | |
| | combination | combination | combination | combination | combination | combination | combination | combination | | |
| | ..... | ..... | ..... | ..... | ..... | ..... | ..... | ..... | | |
| | ..... | ..... | ..... | ..... | ..... | ..... | ..... | ..... | | |

FIG. 4 sound timbre register

| timbre |
| --- |
| tone number |

41(4)

setup timbre register

| | timbre | volume | output range | range setting flag | output state flag |
| --- | --- | --- | --- | --- | --- |
| combination | tone number | loudness | setup range | flag | flag |
| | tone number | loudness | setup range | flag | flag |
| | tone number | loudness | setup range | flag | flag |
| | ..... | ..... | ..... | ..... | ..... |

42(4)

APPARATUS, METHOD AND COMPUTER PROGRAM FOR MEMORIZING TIMBRES

BACKGROUND OF THE INVENTION

1. Field of the Invention

The present invention relates to an apparatus, method and computer program for memorizing timbres.

2. Description of Related Art

The conventional electronic musical instruments/apparatuses have provided various combinations of timbres. In the combinations, for example, the upper keyboard (a high range section) is set for timbre of a piano, and the lower key board (a low range section) is set for timbre of a contrabass.

Such timbre combinations are stored in a memory, read out and used repeatedly.

However, such timbre combinations are registered into vacant storage areas of the storage appliance according to the sequences and are stored this way. Therefore it has been difficult to discover at which address a timbre combination was registered and retrieve it.

The purpose of the present invention is that timbre combinations are arranged when they are stored so that the wished timbre combination can be taken out later again easily.

3. Related Works (1) Japanese Patent Publication No. 9-319370
(2) Japanese Patent Publication No. 5-108070

SUMMARY OF THE INVENTION

1. Present Invention

In order to achieve the above mentioned purpose, the present invention classifies plural timbre generation means to select plural sorts of timbres different from one another into groups according to predetermined numbers of timbres, classifies the timbre data selected by the plural timbre generation means according to the above groups and stores the data in response to said timbre generation means. Furthermore upon storing the combinations of plural timbres selected by the above timbre generation means, a timbre in the combination selected and stored by the above storage means according to the above timbre generation means corresponding to the above timbre group the selected timbre belongs to.

2. Effects of the Invention

The individual timbre combination can be stored and arranged according to timbre groups, so that it is no more difficult to search and retrieve the named timbre combinations. Furthermore the timbre generation means is classified according to the timbre groups, so that selection of the timbre generation means is made simplified.

Since said timbre combinations are stored corresponding to the individual timbre generation means, it is easy to retrieve the timbre combinations. Also the storage means and the timber generation means are divided into the same timbre groups so that the timbre generation means and the timbre combinations show an unequivocally defined relationship and it is comprehensible and easy to retrieve timbre combinations by the timbre generation means.

BRIEF DESCRIPTION OF THE DRAWINGS

FIG. 3 shows the timbre table 61 in the program/data storage unit 4.

FIG. 4 shows the sound timbre register 41 and the setup timbre register 42 in the program/data storage unit 4.

DESCRIPTION OF THE PREFERRED EMBODIMENT

(1) Overall Circuitry

Figure 1:
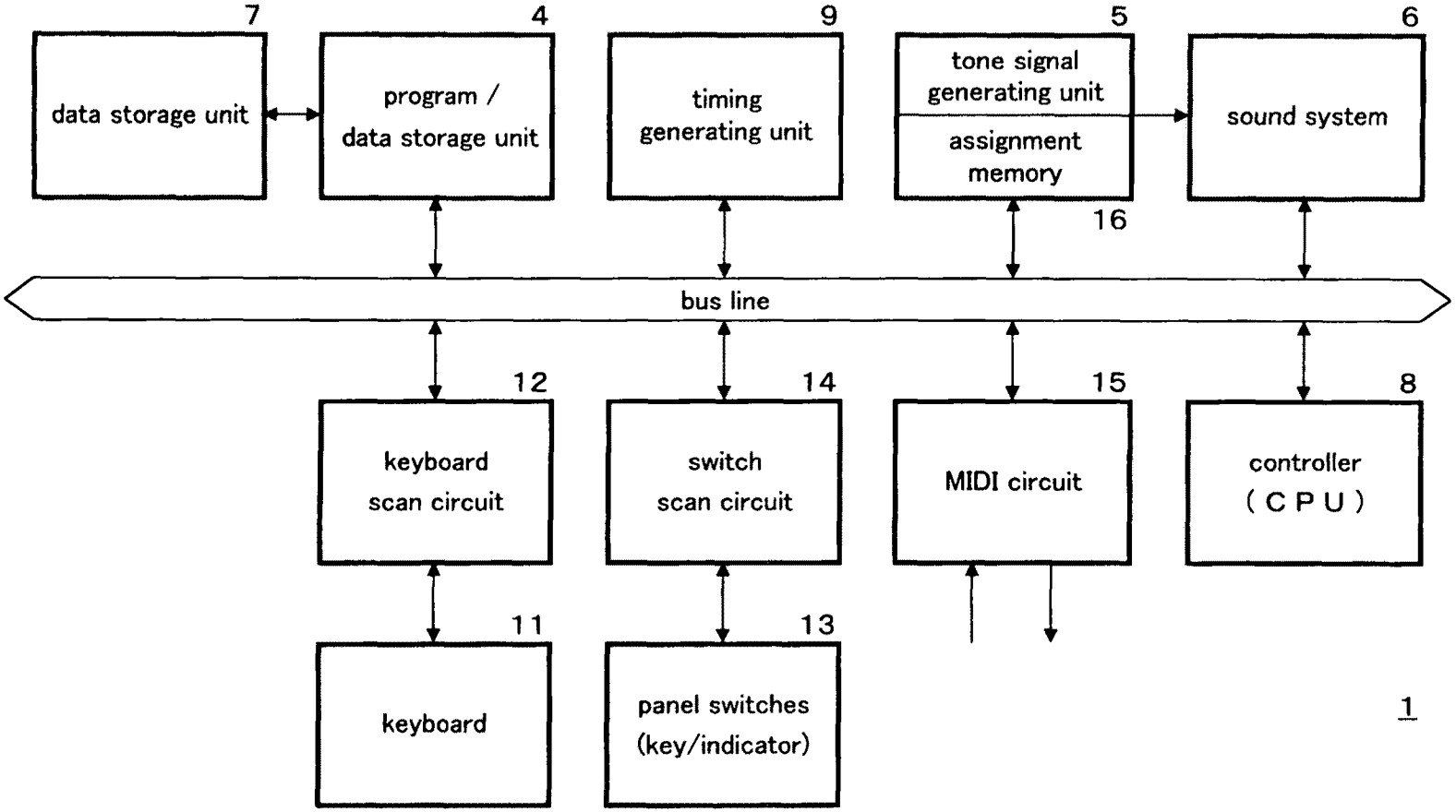
FIG. 1 shows a whole circuit of the timbre storage apparatus 1.

FIG. 1 is a diagram illustrating the overall circuitry of a tone output switching apparatus 1 (a method, device to practice a program, automatic/manual play device, a sequencer, a sound source apparatus, a musical tone apparatus or an electronic musical instrument, thereafter referred to as "said apparatus).

Each key on the keyboard 11 operates/instructs generation and attenuation of musical tones, the keyboard scan circuit 12 practices scanning; a key on/off data is detected and is written in the keyboard table in the program/data storage unit 4 by the controller (CPU) 2. Then it is compared with the data showing the on or off status of each key which has been stored in the keyboard table, and the controller 2 determines the on of off event of each key.

The keyboard 11 consists of a lower keyboard, an upper keyboard and a pedal keyboard. Each of the portions generates tones with different/same timbre, that is, tones with different/same waveform and/or envelope waveform. In some cases the keyboard 11 is replaced by an electronic stringed instrument, an electronic wind instrument, an electronic percussion instrument (pad, etc.) or a computer keyboard.

The keyboard 11 detects tempo or touch of a player's manual performance. In order to detect the touch, a speed sensor, an acceleration sensor or a pressure sensor is provided to correspond to each key of the keyboard 11.

Each switch in the panel switch group 13 is scanned by the switch scan circuit 14. This scanning detects the data showing the on or off status of each switch, and the controller 2 writes the data in the switch table in the program/data storage unit 4.

It is compared with the data showing the on or off status of each switch which has been stored in the switch table, and the controller 2 determines the on or off event of each switch. The above-mentioned panel switch group 13 includes various operation buttons and switches.

The tones are generated by manual play or automatic play replayed from the performance information of the above-mentioned keyboard 11. The performance information, the tone information, the sounding-on or off information (thereafter referred to as "tone information") is sent from the external connecting apparatus from the MIDI circuit 15. Also the tone information is sent to the external connecting apparatus through the MIDI circuit 15.

The transmitted and received information or the tone information include musical factor information and MIDI channel(s) number information regulated by MIDI standard such as timbre information (tone number data/timbre combination set), volume information (loudness data), touch information (velocity data), pitch information (key number data), range information (set-up range data) and/or envelope information.

MIDI circuit 15 is an interface to transmit and receive tone data to and from an externally connected electronic musical instrument. The tone data meets MIDI (musical instrument digital interface) standard, and sounds are generated based on the tone data. MIDI circuit 15 includes a buffer for temporarily storing tone data to be received and transmitted.

The keyboard 11 or the MIDI circuit 15 formerly mentioned includes manually and automatically played musical instruments. The above-mentioned performance information, etc. (tone data) generated from the keyboard 11, the panel switches 13 or the MIDI circuit 15 is information to generated musical tones.

The above-mentioned tone pitch data is received as a key number data KN. The key number data KN includes octave data (tone pitch data) and tone name. The above-mentioned timbre data corresponds to the kind of the musical instruments (sounding media/sounding means) such as keyboard instruments (piano, etc.), wind instruments (flute, etc.), stringed instruments (violin, etc.), percussion instruments (drum, etc.) and are received as a tone number data TN. The above-mentioned envelope data includes the envelope speed ES, the envelope level EL, the envelope time ET and/or the envelope phase EF, etc. formerly stated.

Such musical factor data are sent to the controller (CPU) 8 where a variety of signals that will be described later, data or parameters are changed to determine the content of musical tones. The performance information, etc. is processed by the controller 8, various data are sent to the musical tone signal output unit 5, tone waveform signals are generated and the sound system 6 generates and outputs sounds. The controller 8 consists of CPU, DSP (digital signal processor) ROM and RAM.

A program/data storage unit 4 (internal storage medium/means comprises a storage unit such a ROM, a writeable RAM, a flush memory or an EEPROM. A program of a computer stored in a data storage unit 7 (external storage medium/means) such as an optical disk or a magnetic disk, is transcribed and stored (installed/transferred) into the program/data storage unit 4.

Into the program/data storage unit 4 is further stored (installed/transferred) a program transmitted from an external electronic musical instrument or a computer via the MIDI circuit 15 or the transmission/reception device. The storage medium of the program includes a communication medium.

This program complies with flowcharts that will be described later, with which the controller (CPU) 8 executes a variety of processings. The program/data storage unit 4 stores the above-mentioned musical factor data, the above-mentioned various data and other various kinds of data. These various kinds of data include data necessary for the time-division processing and data to be assigned to the time-division channels.

In the tone signal generating unit 5, tone waveform signals are repeatedly generated for each tone and the sound system 6 generates and outputs sounds. In response to the above-mentioned pitch data, the speed of the repeatedly generated tone waveform signals is changed, and in response to the musical factor data such as the above-mentioned tone data, the forms of the repeatedly generated tone waveform signals are transformed. In the tone signal generating unit 5, more than one tone signals are created simultaneously and independently in parallel to generated polyphonic sounds through a time sharing process.

A timing generating unit 9 outputs timing control signals to the circuits to maintain synchronism of all circuits of the tone generating apparatus. The timing control signals include clock signals of each of the periods, signals of a logical product or a logical sum of these clock signals, channel clock signals having periods of channel-dividing time in the time-division processing, clock signals with integral multiplied or integral divided frequencies by these signals, channel number data CHNo and time count data (tone generating data). The above-mentioned scan processing is executed according to the clock signals at every particular period.

The tone signal generating unit 5 or the program/data storage unit 4 includes the assignment memory 16. The assignment memory 16 has a memory area corresponding to the number of the above-mentioned time-division channels so that the performance information tone data and musical factor data are written in to generate said tones in response to tones assigned to each channel. The tones assigned to each channel are generated or attenuated in response to the written tone data, etc.

(2) Panel Switch Group 13

Figure 2:
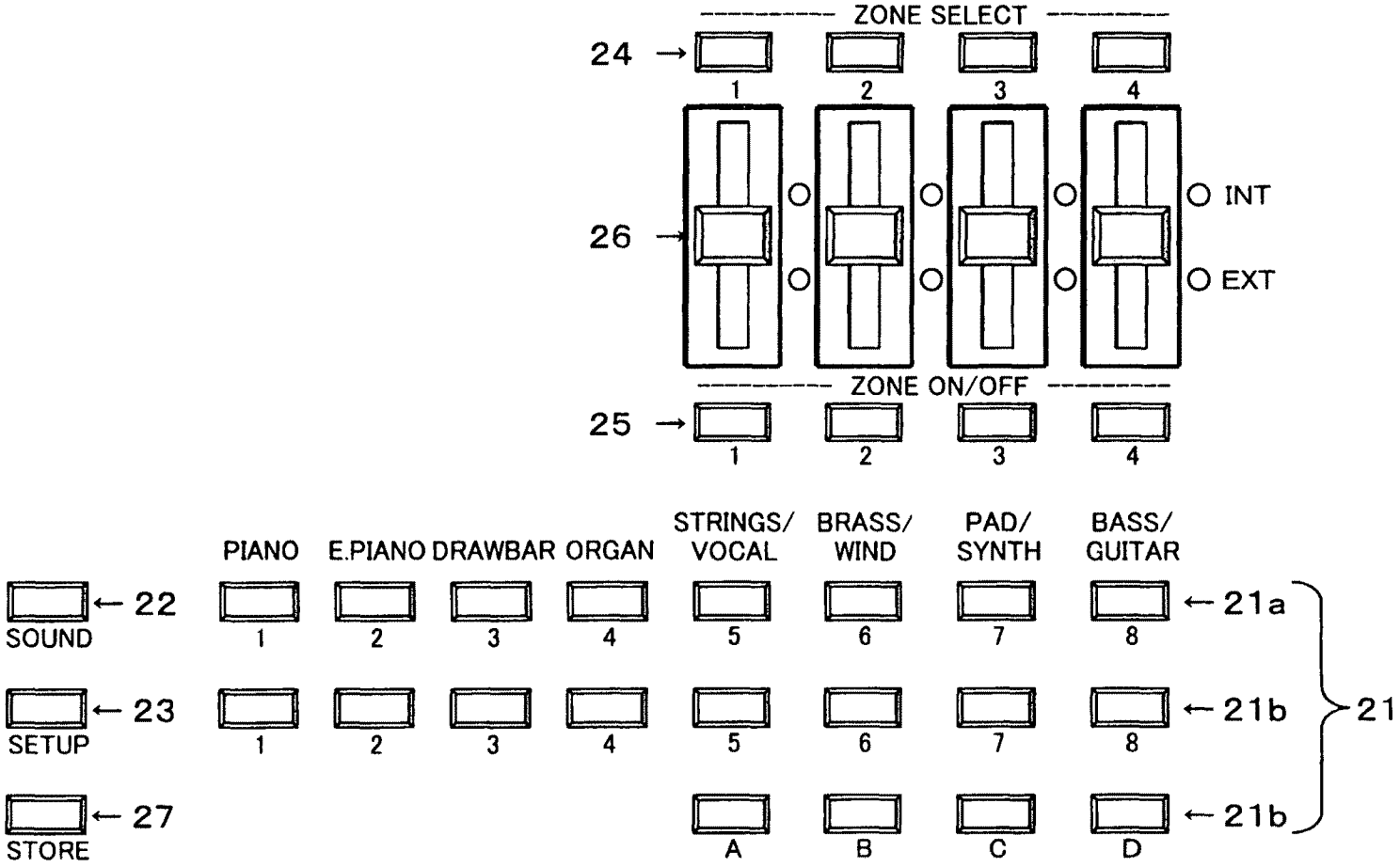
FIG. 2 shows a part of the panel switch group 13.

FIG. 2 shows a part of the above panel switch group 13. The panel switch group 13 includes the timbre button 21, the sound button 22, the setup button 23, the zone select buttons 24, and the zone on/off buttons 25, the zone faders 26 and the store button 27.

By the timbre buttons 21, various timbre information (tone number data) are designated/selected and select one timbre for one tone among various timbres and tones which are different from one another. The timbre buttons 21 include the timbre group buttons 21*a* and the variation buttons 21*b* which designates specific timbres subdividing the each timbre group.

The above timbre groups are broadly classified/arranged according to timbres of musical instruments such as keyboard, wind, stringed and percussion instruments. The above "specific timbers" are classified/arranged according to specific sorts of musical instruments such as piano, organ, violin cello, flute, trumpet, drums and cymbals, waveforms of the envelope, frequency components, volume of reverberation and resonance. Therefore the specific timbres are classified into timbre groups by the predetermined number of timbres.

The procedure of designating the timbres is that the timbre group buttons 21*a* designate/select the above broadly grouped timbres first and then the variation buttons 21*b* designate/select the above specific timbres. The timbre group buttons 21*a* make a selection from eight types of the broadly groups timbres. The upper eight and the lower four variation buttons 21*b* select 32 types of specific timbers. Thus 256 types of specific timbres are selected altogether.

In addition to the variation buttons 21*b*, operation of other knobs helps changed waveform of the envelope, frequency components, volume of reverberation and resonance as well as the specific sorts of musical instruments. Therefore the variation buttons 21*b* are arranged under the timbre group buttons 21*a* according to the predetermined number of timbers.

The above broadly grouped timbers and specific timbres may correspond to the basic envelope wave form and its variations, the basic waveforms of tones and their variations or the waveforms with the content of the harmonics components changed, the basic envelope waveform and its accompanying envelope waveforms, waveforms of changed volume of reverberation or resonance, the basic waveforms of tones and their accompanying waveforms of tones and waveforms of changed volume of reverberation and resonance.

With the sound button 22 on, the above timbre buttons 21 select a mode in which one timbre is selected for one tone among various timbres and tones which are different from one another, as previously mentioned. The setup button 23 selects a mode in which the timbre combinations designated/selected by the above timbre buttons 21 are made, written-in/memorized or the memorized combinations of timbres are read-out/replayed.

Thus the memorized timber combinations are classified/arranged according to the above respective timbre groups and are memorized according to the above respective specific timbres. The timbre combinations are classified into the timbre groups and memorized corresponding to the timbre group buttons 21*a*, and are memorized corresponding to any of the above variation buttons 21*b* under the timbre group buttons 21*a*.

Therefore each of the above timbre combinations is memorized corresponding to each of the above timbre buttons 21 (the timbre group buttons 21 and the variation buttons 21*b*), and at the same time each of the above various sorts of timbres is memorized corresponding to each of the above timbre buttons 21. In this way the sound button 22 and the setup button 23 switch the corresponding status of the timbre combinations and the corresponding status of the various sorts of timbres.

The four "1" to "4" zone select buttons select and designate the first, second, third and fourth timbres of the above timbre combinations separately and individually. The selection and designation is possible both at writing-in/storage and reading-out/replay of the timbre combinations.

The No. "n" timbre selected and designated from the combination is specifically selected and decided by the above timbre buttons 21. Moreover the No. "n" timbre is changed individually by switching the above timbre buttons 21. Loudness of No. n timbre is set, selected or changed individually by the zone faders 26 mentioned later.

The envelope waveforms, the frequency components, volume of reverberation and resonance of the No. n timbre are finely adjusted with the above operation knobs (not illustrated), and each timbre of the timbre combinations is able to be individually processed. In this way the timbres selected by the zone select button 24 may be selected and designated individually when the above sound button 22 is on or may be one of the above timbre combinations by the timbre buttons 21 when the above setup button 23 is on.

If two arbitrary keys of the above keyboard are pressed with the zone select buttons 24 on, the range is designated in which only the tones included in said timbre combinations are able to be generated/outputted. The range is a certain range between the pressed two keys. The tones of said timbres are not generated/outputted outside of the certain range.

The four "1" to "4" zone on/off buttons 25 switch sequentially the respective zone's generation status of timbre of the above timbre combinations: timbres of said combinations are muted without being generated, tones of all the ranges/keys are generated in the timbres in said zone, and tones of the ranges/keys within said range area are generated in said zone.

The switching of the zone on/off button 25 is operated when the above sound button 22 and/or the setup button 23 are pressed, that is, at the time of reading-out/replay and writing-in/storage of both a single timbre and a timbre combination. But in some cases when the zone on/off button 25 is on, it is acceptable that the timbre combination designated by the above setup button 23 is automatically readout. It means that the status of reading-out/replay of timbre combinations is forced to be set.

The zone faders 26 adjust volume/loudness of said timbre combinations individually. The individual adjustment of volume of timbres in the combinations is possible in any mode of writing-in/storage or reading-out/replay of the timbre combinations.

Each timbre of said combinations is selected by the zone select button 24 at writing-in/storage of the timbre, and is selected by the zone on/off button 25 at reading-out/replay of the timbre. Therefore selection of the timbres is performed by an operator.

The store button 27 writes and stores said single timbre or timbres in said combination selected and designated by the timbre buttons 21 in the vacant area on the timbre table 61 in the program/data storage unit 4. At that time a single timbre is written into the memory area of the timbre group which said timbre (tone number data) belongs to and timbres in the combination are written into the memory area of the timbre group which timbres (tone number data) in said combination belong to. Selection of timbres (zone) in the combination is made by said zone select button 24.

(3) Timbre Table 61 (4)

FIG. 3 shows said timbre table 61 in the program/data storage unit 4. The timbre table 61 is divided into areas for each of said timbre groups (broadly classified timbres). Each timbre group area is divided into a sound area and a setup area.

The top part of the sound area in each timbre group area stores the above single tone number data (a single timbre data) in advance, and the rest areas are vacant. The top part of the setup area in each timbre group stores plural tone number data (timbre data) of the above combination sets in advance, and the rest area are vacant.

Into these vacant areas in each of the sound areas written is a single tone number data processed and set by the operator's controlling the store buttons 26. Into the vacant areas in each of the set area is written plural tone number data processed and set by the operator's controlling the store buttons 26.

Loudness data and setup range data are added to each of the plural tone number data of the combinations. The loudness data show volume of each timbre of the combinations. The setup range data show ranges that each timbre of the combinations is able to cover in the keyboard 11. Tones with said timbres are not generated outside of the ranges.

Each storage address of the timbre table 61 corresponds to the above timbre buttons 21 (the timbre group buttons 21*a* and the variation buttons 21*b*), and the single tone number data and/or the timbre combination sets above mentioned are stored at the memory addresses. By operating the timbre buttons 21 for selection and instruction, read out are the single tone number data and/or the timbre combination sets stored at the corresponding storage addresses.

(4) Sound Timbre Register 41/Setup Timbre Register 42

FIG. 4 shows the timbre register 41 and the setup timbre register 42 in the above program/data storage unit 4. In the sound timbre register 41 are stored single tone number data inputted by the timbre buttons 21 after the sound button 22 is pressed. The timbres of the tone number data of the sound timbre register 41 are processed, or without being processed, and written into the sound area on the timbre table 61.

In the setup timbre register 42, the tone number data (timbres), the loudness (volume) and the setup range data (sound generation range/output range) of each timbre in the timbre combinations inputted by the timbre buttons 21, the zone faders 26 and the keyboard 11 when the setup button 23 is pressed. The timbres of the tone number data of the setup timbre register 42 are processed or not processed, and the loudness is changed or not changed, the setup range data is set or changed, and they are written into the step area of the above timbre table 61.

In the setup timbre register 42, the range setting flag and the output state flag are stored for each timbre of the combinations. The range setting flag shows the state that the above setup range data (sound generations range/output range) is set on the keyboard 11 when the zone select buttons 24 are pressed. The output state flag shows the sound generation range/output range of each timbre in the combinations when the zone on/off buttons 25 are pressed in sequence.

When the output state flag is "0", only the tones with the timbres of the above timbre combinations in said zone are muted and are not generated. When the output state flag is "1", timbres in said zones are generated in all the ranges with all the keys of the keyboard 11. When the output state flag is "2", sounds are generated in said zones in the ranges/with the keys in the range area set as mentioned above. Corresponding to these output state flags, the red lamp or the green lamp is lighted to distinguish the output state flags visually.

(5) Overall Processing

Figure 5:
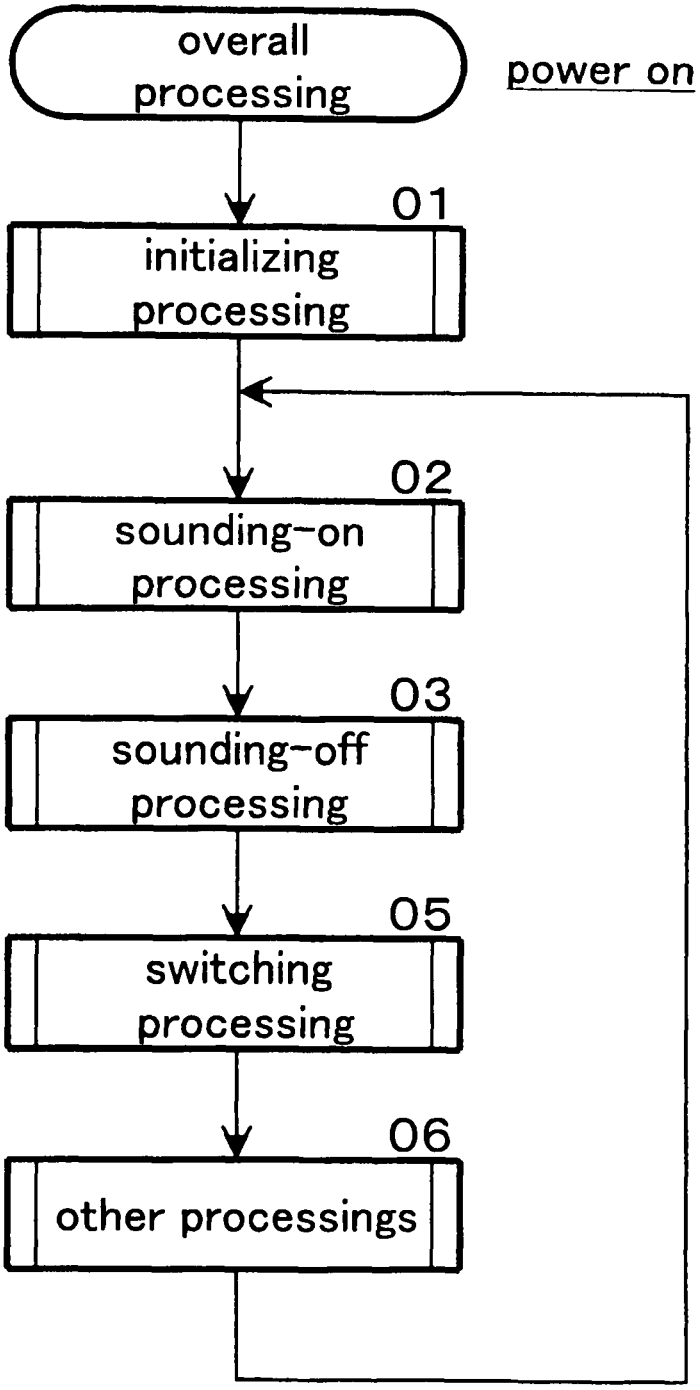
FIG. 5 shows a flowchart of the whole processing executed by the controller (CPU) 8.

FIG. 5 shows a flowchart of the overall processing executed by the controller (CPU) 8. The overall processing starts as the power source of the tone generating apparatus is turned on, and is repetitively executed until the power source is turned off. First a variety of initialize processing such as initializing the program/data storage unit 4, etc. are executed (step 01), and the sounding-on processing is executed based on the key-on operation of the manually play of the keyboard 11 (step 02).

The sounding-on processing is executed also when the key-on data of the automatic play is read out from the program/data storage unit 4 while reading out and replaying the above-mentioned performance information. The step 02 sounding-on processing is executed also when the key-on data of the automatic play is written into the program/data storage unit 4 while writing in and recording the performance information.

In the sounding-on processing, vacant channels are searched, and musical tones related to the on-event are assigned to the vacant channels that have been searched. Contents of the musical tones are determined by musical factor data of performance information (tone data) and tone generating data from the keyboard 11 and the panel switches 13.

In this case, the on/off data of "1", the key number data (frequency number data) KN, envelope data, tone number data TN and touch data TC are written into the areas of the assignment memory of vacant channels that have been searched. The data written into the assignment memory is transmitted to the tone generating unit 5 to get the corresponding tone waveform data read out and the corresponding envelope waveform data outputted so that sounds are generated by the sound system 6.

Then the sounding-off (attenuation) processing if effected based on the key-off operation of the manual play with the keyboard 11/panel switches 13 (step 03). In the sounding-off (attenuation) processing, channels to which assigned are the tones related to the off event (key-off event, sounding-off event) are searched, and the on/off data in the assignment memory (not illustrated) is made "0" to attenuate and sound of the tones. In this case, the on/off data "0" in the assignment memory is transmitted to the tone signal generating unit 5 to release the envelope phases of the tones related to the key-off event, and the envelope levels gradually approach to "0".

The sounding-off processing in the step 03 is executed when the key-off data of automatic play is read out from the program/data storage unit 4 while reading out and replaying performance information. The sounding-off processing in the step 03 is also executed when the key-off data of automatic play is written into the data storage unit 4 while writing in and recording performance information.

By operating with the panel switches 13, the corresponding musical factor data are taken in and are stored in the program/data storage unit 4 to change the musical factor data (step 05). This switching operation practices selection of timbres and writing in reading out of the timbre set, followed by other processing (step 06). The processing is repeated from the step 02 through up to the step 06.

(6) Switch Processing (Step 05)

Figure 6:
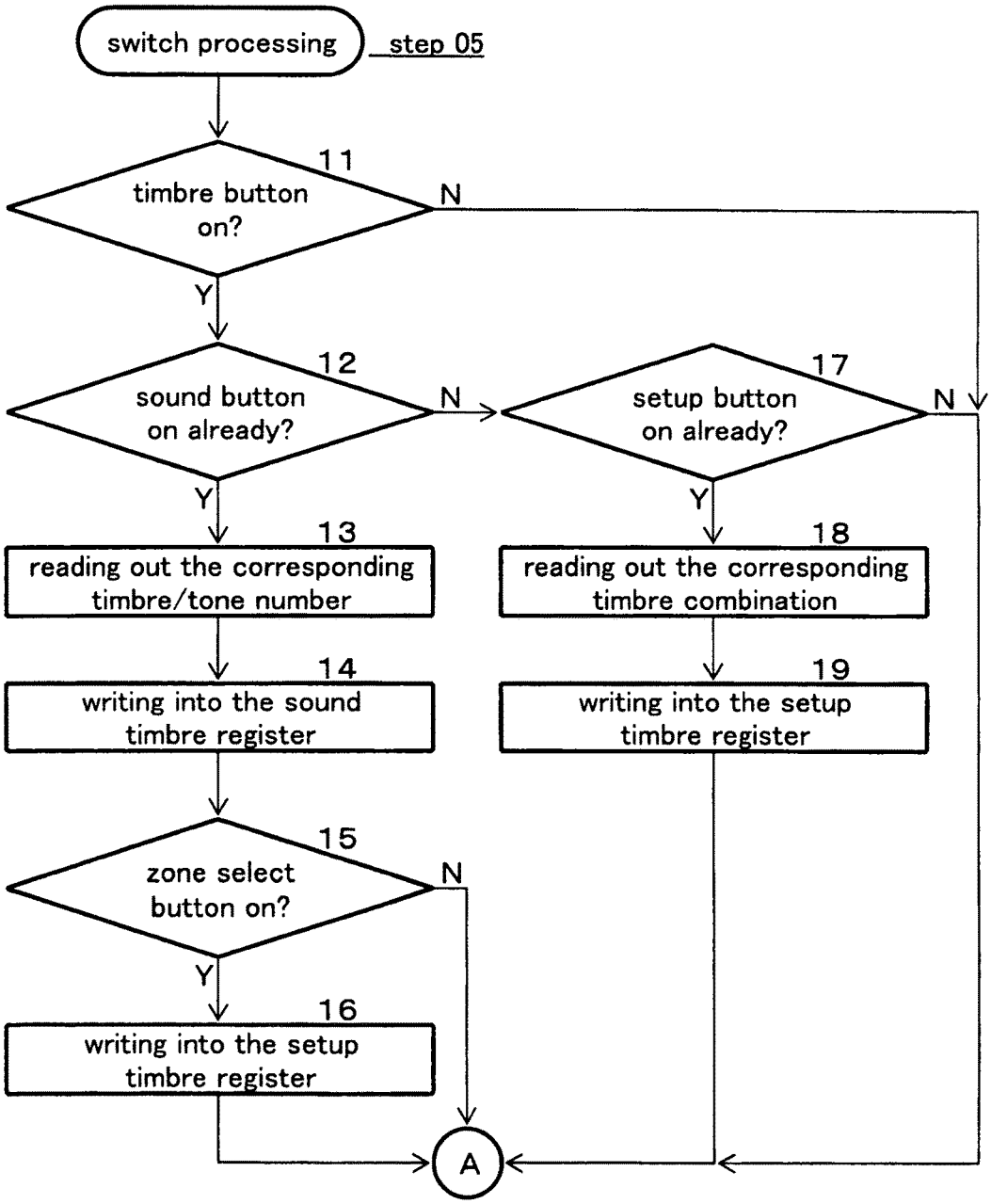
FIG. 6 shows a flowchart of the processing performed with the timbre button 21 on for the switch processing (step 05).

FIG. 6 shows a flowchart of processing by the timbre buttons 21 for the switch processing (step 05). First when the timbre buttons 21 are pressed (step 11) and if the sound buttons 22 are pressed (step 12), the tone number data (timbre data/timbre code) corresponding to the operated timbre button 21 is read out from the sound area on the timbre table 61 (step 13), and is written into the sound timbre register 41.

Accordingly every time the key-on takes place on the keyboard 11, the tone number data of the sound timbre register 41 is written into the vacant area of the assignment memory 16 as well as key cord (pitch data/range data), velocity (touch data) and loudness (volume data), tone are assigned to time-division manner (time-sharing manner) channels, and the tones are generated with said timbres.

At the same time if one of the zone select buttons 24 "1" to "4" is turned on (step 15), the above tone number data are written into the setup timbre register 42 corresponding to the zone select buttons 24 turned on. (step 16)

Accordingly one timbre in the timbre combination is set. Then if the zone select button 24 is switched and the selected zones are switched, the tone number data that have been selected by the timbre buttons 21 are written into each of the zones of the setup timbre register 42 (step 34 mentioned below). Thus at most four timbres are set in each of the timbre combinations.

When the timbre buttons 21 are pressed in the above step 11 and if the setup button 23 is pressed (step 17), plural tone number data (timbre combinations/timbre data), loudness data (volume data) and setup range data corresponding to the operated timbre buttons 21 are read out from the setup area on the timbre table 61 (step 18) and are written into the setup timbre register 42 (step 19).

Accordingly every time the key-on takes place on the keyboard 11, plural tone number data (timbre combinations) of the setup timbre register 42 are written into the vacant area of the assignment memory 16 as well as key cord (pitch data/range data), velocity (touch data) and loudness (volume data), tones are assigned to time-division manner (time-sharing manner) channels, and the tones are generated with various timbres in said timbre combinations.

The above processing from the steps 11 to 14 and from the steps 17 to 19 are executed not only when timbres are newly selected but also when a timbre combination or a singly timbre stored in the timbre table 61 is read out and one or all of the timbres are changed and processed/changed.

(7) Switch Processing (Step 05)

Figure 7:
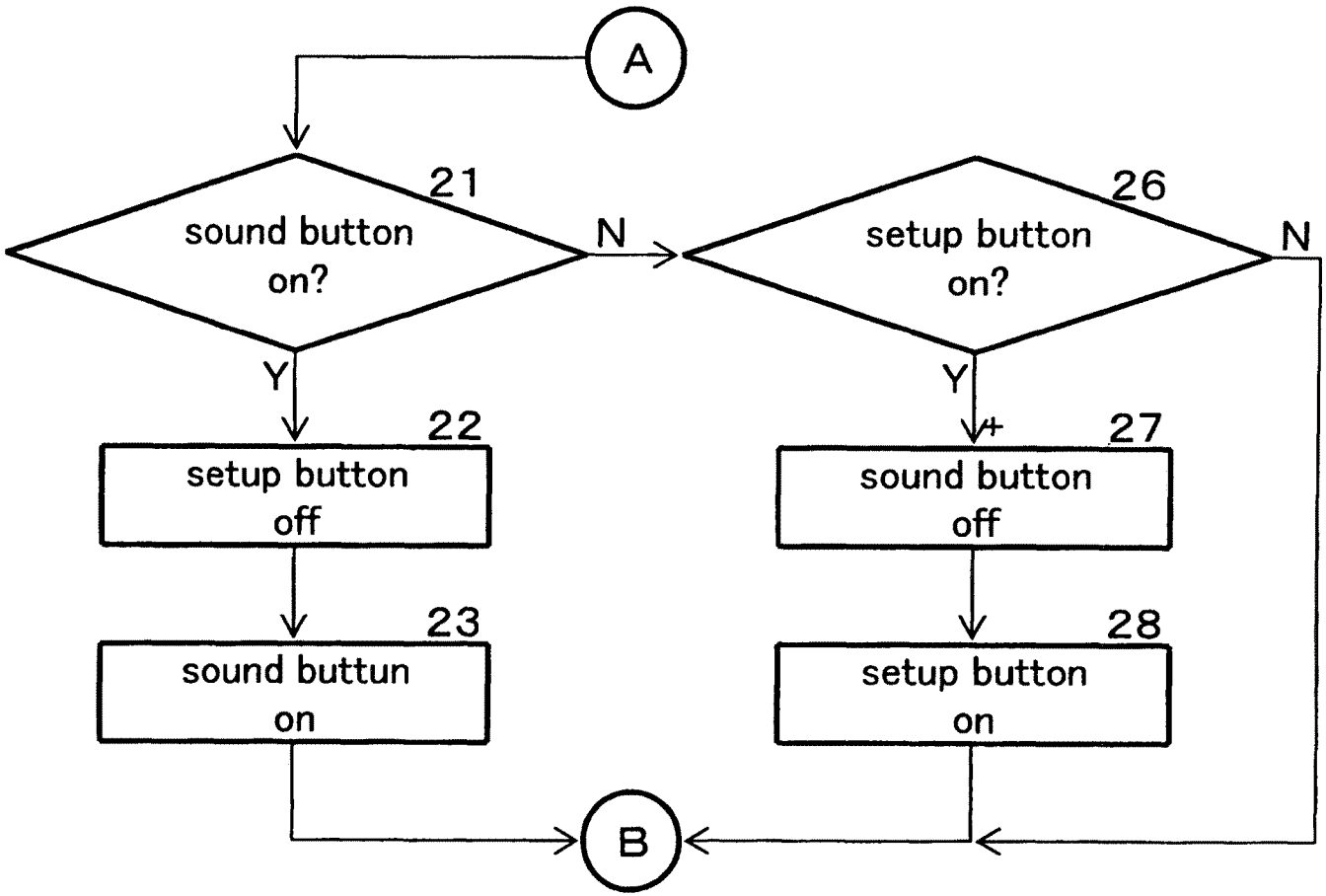
FIG. 7 shows a flowchart of the processing performed with the sound button 22 and the setup button 23 on for the above switch processing (step 05).

FIG. 7 shows a flowchart of processing operated by the sound button 22 and the setup button 23 in the above switch processing (step 05). First when the sound button 22 is turned on/operated (step 21), the areas covered by the setup button 23 on the switch table is cleared (step 22), and "1" is stored in the area covered by the sound button 22 on the switch table (step 23).

When the setup button 23 is pressed (step 26), the area covered by the sound button 22 on the switch table is cleared (step 27) and "1" is stored in the area covered by the setup button 23 on the switch table (step 28).

Accordingly the sound button 22 and the setup button 23 are toggle switched, and one of them is alternatively selected. Therefore two statuses are alternatively switched: that each of the above plural tone number data (timbre combinations) corresponds to each of the timbre buttons 21 and that each of the above various sorts of tone number data (timbre data) corresponds to each of the timbre buttons 21.

As a result selection of plural timbre combinations and selection of single timbre data are not mixed/confused. However if there are many timbre buttons 21, the sound button 22 and the setup button 23 are eliminated and two statuses exist at the same time: that each of the above plural tone number data (timbre combinations) corresponds to each of the timbre buttons 21 and that each of the above various sorts of number data (timbre data) corresponds to each of the timbre buttons 21.

(8) Switch Processing (Step 05)

Figure 8:
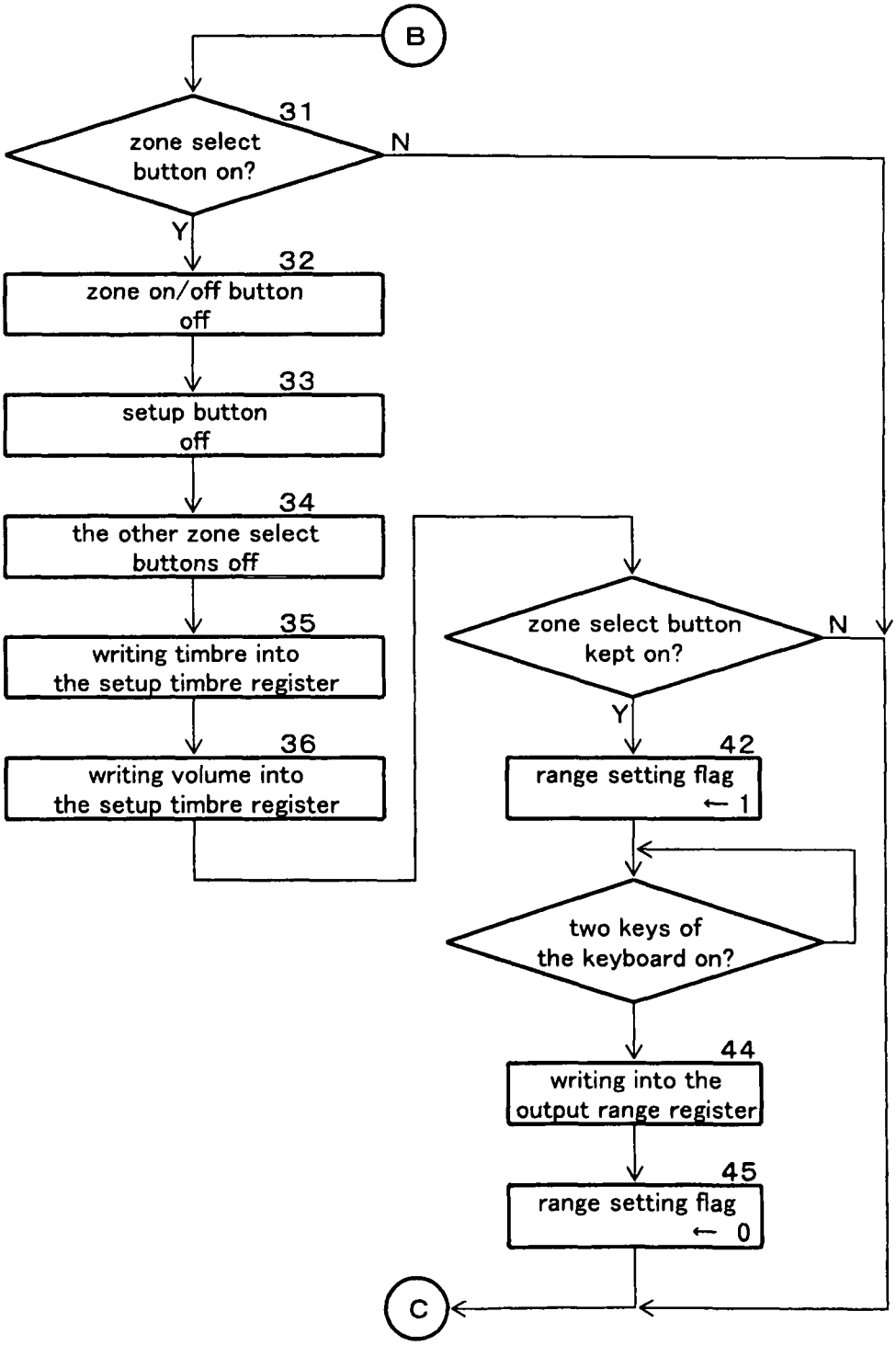
FIG. 8 shows a flowchart of the processing performed with the zone select button 24 and the zone faders 26 on for the above switch processing (step 05).

FIG. 8 shows a flowchart of processing operated by the zone select buttons 24 and zone faders 26 in the above switch processing (step 05). First when one of the zone select buttons 24 "1" to "4" is turned on (step 31), cleared are all the areas covered by the four zone on/off buttons 25 on the switch table (step 32) and the area covered by the setup button 23 is cleared (step 33). Accordingly the writing-in/setting status is set for the timbre combinations and the reading-out/replay status is cleared for the timbre combinations.

Then the areas on the switch table are cleared corresponding to the zone select buttons 24 for the other zones than are covered by the zone select buttons 24 that have been turned on. (step 34). Accordingly writing-in/setting of the timbre combinations is executed independently/separately for each timbre/zone of the timbre combinations and therefore cannot be confused. Plural or all of the timbres in the timbre combinations may be of course set/adjusted at the same time.

At that time the tone number data selected by the timbre buttons 21 are written into an area for one corresponding zone "1" to "4" of the setup timbre register 42 (step 35). As a result one timbre in the timbre combination is set.

Then if the timbre button 21 is switched and selected timbres are switched, the tone number data written into the corresponding zones of the setup timbre register 42 are switched (the above steps 15 to 16). Accordingly every timbre of the timbre combinations is able to be switched.

At that time loudness data (volume data) corresponding to operation of the zone faders 26 are written into an area for one corresponding zone "1" to "4" of the setup timbre register 42 (step 36). Accordingly volume of one timbre in the timbre combination is set.

At this occasion, if it is recognized that the zone select buttons 24 are pressed longer than a certain fixed time (step 41), the range setting flag is stored in an area for one corresponding zone "1" to "4" of the setup timbre register 42 (step 42).

Then if two keys are pressed on the keyboard 11 while the zone select buttons 24 are pressed (step 43), the two key number data for the both two keys are written into an area for one corresponding zone "1" to "4" of the setup timbre register 42 (step 44) and the range setting flag is cleared (step 45).

Accordingly the sound ranges are individually set for tones generated/outputted with each timbre of the timbre combinations set as mentioned above in said zone. The range is a sound range area between the above two key number data. As for output range/sound generation range of each timber in the timbre combinations, the upper keyboard part of the keyboard 11 covers one range and the lower keyboard part covers the other range. Thus the keyboard 11 is divided into plural ranges and each of the ranges outputs/generates tones with different timbres.

Sound generation/output range of each timbre of such timbre combinations overlaps or does not overlap one another. If a key in an overlapped range is pressed, the tones are generated with two different timbres. Therefore in the overlapped range, tones with plural timbres are simultaneously generated/outputted by taking one sound generation operation of the key board 11 (the musical tone apparatus). And in the non-overlapped ranges, tones with different timbres are generated/outputted in the different ranges.

This range area may be designated commonly/collectively to all the timbre combinations. In this occasion the setup range data designated at the above steps 41 to 45 are commonly written into all the zones of the setup timbre register 42.

(9) Switch Processing (Step 05)

Figure 9:
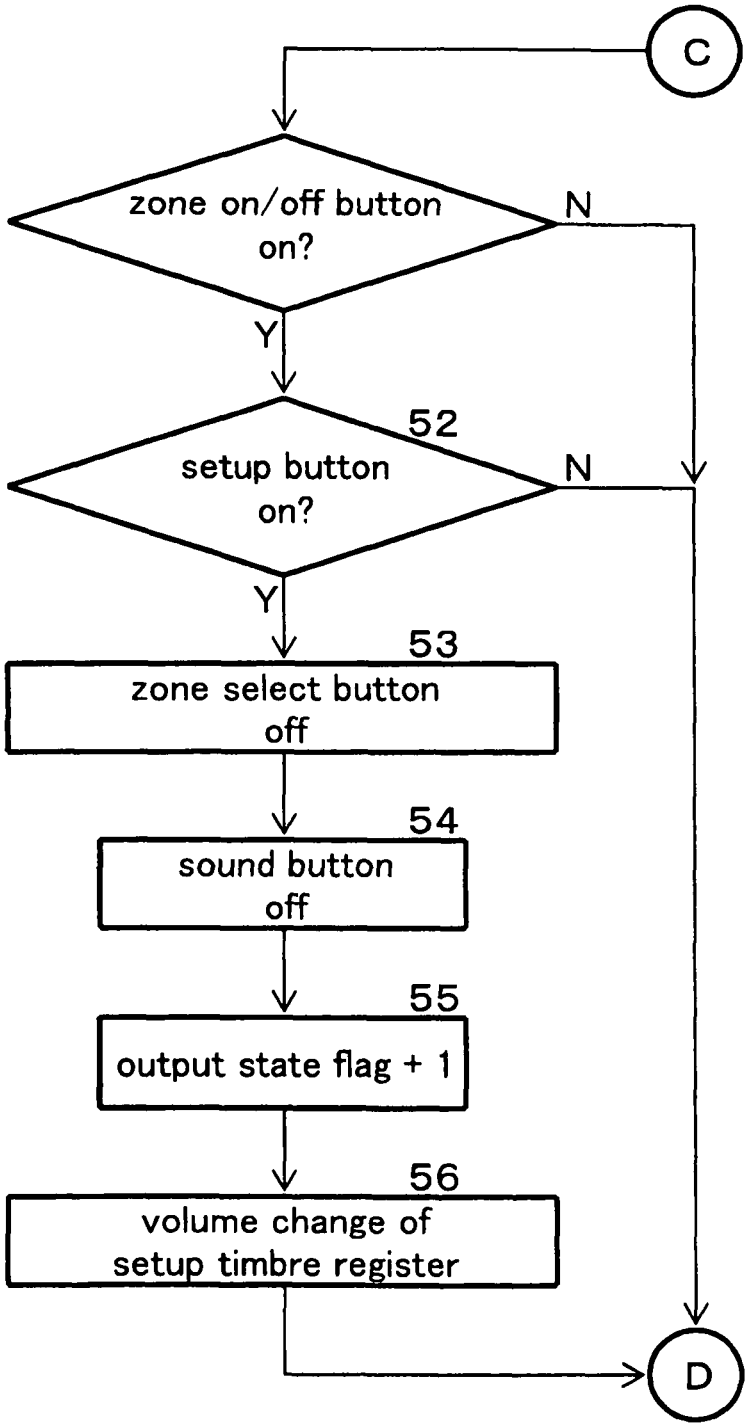
FIG. 9 shows a flowchart of the processing performed with the zone on/off buttons 25 and the zone faders 26 on for the above switch processing (step 05).

FIG. 9 shows a flowchart of processing operated by the zone on/off buttons 25 and the zone faders 26 in the above switch processing (step 05). First when the zone on/off buttons 25 are operated (step 51) and if the setup button 23 is turned on (step 52), all the areas covered by the four zone select buttons 24 on the switch table are cleared (step 53), and then the area covered by the sound button 22 is cleared (step 54).

Accordingly the writing-in/setting status of the timbre combinations is removed, which makes it required that the reading-out/replaying status of the timbre combinations has been set. Therefore it is required that the setup button 23 has been turned on and that the tone number data (timber data) has already been written into the setup timber register 42 as well as the loudness data (volume data) and the setup range data. (steps 17 to 19)

Then the output state flag of one of the zones "1" to "4" that the setup timbre register corresponds to is increased by "1" (step 54). Every time the zone on/off buttons 25 are pressed, the output state flag is counted sequentially like 0→1→2→0 . . . .

When the output state flag is "0", the only tones muted, not generated, are those with timbres in said zones in the timbre combinations. At the output state flag "1", tones of all the ranges/keys of the keyboard 11 are generated in the timbres in said zone. At the output state flag "2", tones of the ranges/keys in the range area set as above are generated in said zone. In response to the output state flags, a red or green lamp is lighted in the zone on/off buttons 25, and the output state flag is able to be distinguished visually.

At this time if the zone faders 61 are operated, loudness data (volume data) of the zones "1" to "4" that the setup timbre register 42 corresponds to are changed accordingly. (step 56) Thus volume of tones with each timbre is adjusted individually in the timbre combinations. If any key of the keyboard 11 is pressed, said key number data are not sent to the assignment memory 16 and tones are not generated at the output state flag "0".

If the above output state flag is "1", said key number data (pitch data) are all sent to the assignment memory 16 as well as tone number data (the timbre combinations), loudness (volume data) and velocity (touch data) for said zone of the setup timbre register 42, and tones are generated.

If the above output state flag is "2" and when said key number data (pitch data) exist in the setup range data for said zone in the setup timbre register 42, said key number data are sent to the assignment memory 16 as well as tone number data (the timbre combinations), loudness (volume data) and velocity (touch data), and tones are generated. If the key number data (pitch data) do not exist in the setup range data for said zone in the setup timber register 42, said key number data are not sent to the assignment memory 16, and tones are not generated.

In this way as for the timbre combinations that have been written in/set and stored, tones with timbres belonging to any one or more than one zones are prevented from being generated/outputted. Only the tones with timbres belonging to the rest of the zones are generated. As volume of these tones is controlled individually, the tones are able to be distinguished by listening to them while changing the volume.

In addition the range of tones to be generated/outputted with each timbre in the timbre combinations is selected from the specific range of the keyboard 11 (the musical tone apparatus) appointed by the above setup range data, all the ranges and no-sound ranges (the above muted states).

The volume of tones with each timbre in the timbre combinations may be controlled collectively. In this occasion if the zone faders 26 are operated in the above step 56, loudness data (volume data) are changed collectively for all the zones "1" to "4" in the setup timbre register 42.

(10) Switch Processing (Step 05)

Figure 10:
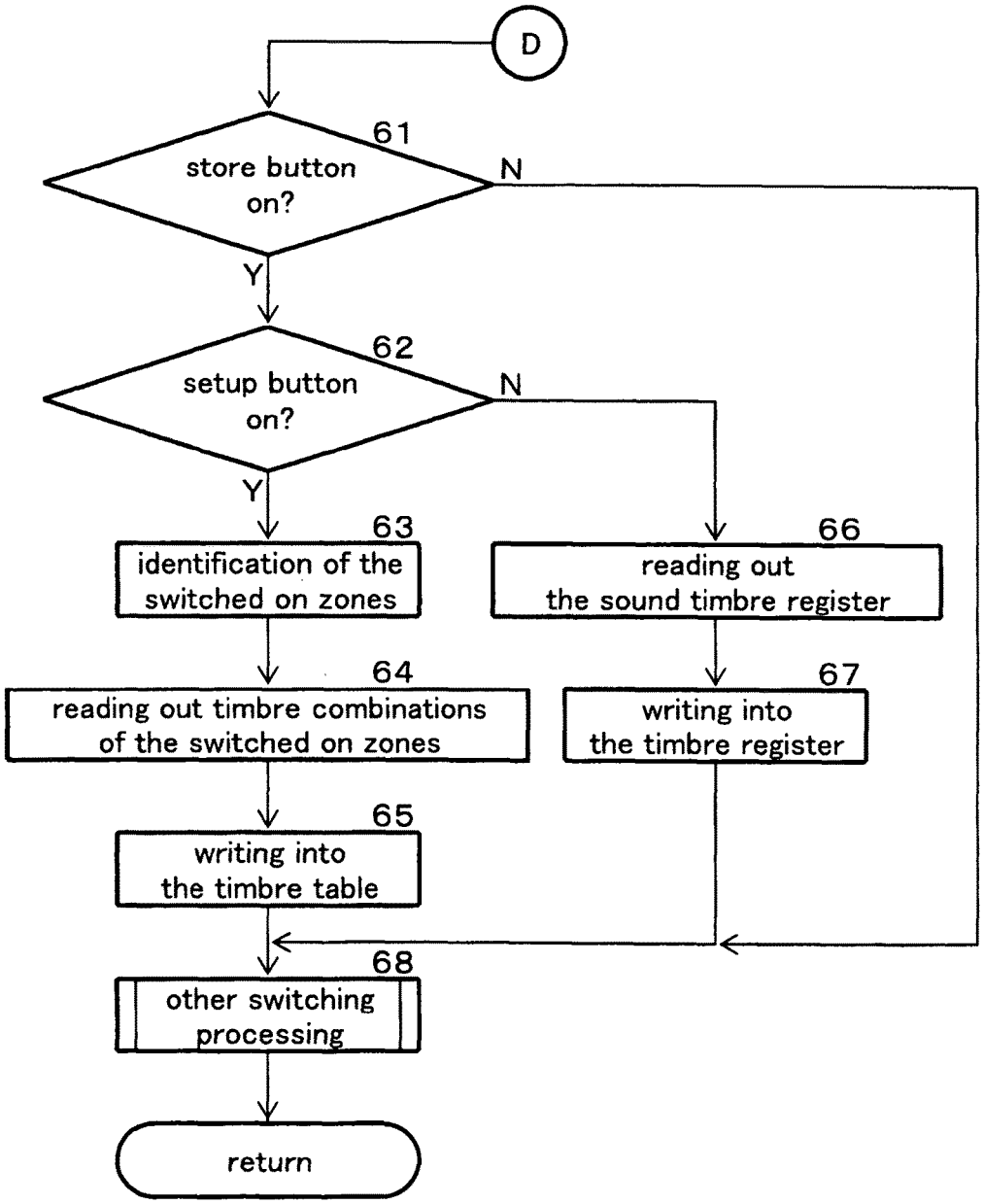
FIG. 10 shows a flowchart of the processing performed with the store button 27 on for the above switch processing (step 05).

FIG. 10 shows a flowchart of processing operated by the store button 27 in the above switch processing (step 05). First when the store button 27 is turned on (step 61) and if the setup button 23 is turned on according to the stored memory in the switch table (step 62), it identifies the zone for which the zone select button 24 on the switch table is turned on (step 63), and the tone number data of the selected zone is read out from the above setup timbre register 42 (step 64).

Then at the top address of the vacant area in the setup area of the timbre group areas in the timbre table 61 corresponding to the selected tone number data, written in and stored are tone number data, loudness data and setup range data of all the zones in the setup timbre register 42 (step 65).

Thus the timbre combinations are classified, stored and arranged according to tone number data/timbre groups of the timbre combinations, which makes it easy to search and take out a timbre combination. In addition the timbre buttons 21 are arranged by the timbre groups and it is easy to select the timbre buttons 21.

Said timbre combinations are memorized in the timbre table 61 corresponding to each of the timbre buttons 21, and it is easy to take out a timbre combination. As the timbre tables 61 and the timbre buttons 21 are classified into the same timbre groups, it is clear which timbre button 21 corresponds to which timbre combination and it is easy to take out a timbre combination by the timbre button 21.

If the setup button 23 is not turned on in the above step 62 (step 62), the tone number data in this zone in the sound timbre register 41 is read out (step 66). And at the top address in the vacant area in the sound area in the timbre group areas of the timbre table 61 corresponding to the selected tone number data, written in and stored are the tone number data of the sound timbre register 41 (step 67).

Thus a single timbre with or without being processed is classified, memorized and arranged according to the tone number data/timbres, which makes it easy to search and take out the processed timbre. In addition the timbre buttons 21 are classified by the timbre groups so that selection of the timbre buttons 21 is made easy.

As said processed timbre is memorized in the timbre table 61 corresponding to each of the timbre buttons 21, it is easy to take out the processed timbre. And also the timbre tables 61 and the timbre buttons 21 are arranged by the same timbre group, which makes clear which timbre button 21 corresponds to which processed timbre and makes it easy to take out processed timbres by the timbre buttons 21.

When timbre combinations are written in at the above steps 61 to 65 and if one zone, that is, one timbre is set, tone number data, loudness data, setup range data of a single timbre are only to be written into the timbre table 61.

At the above steps 61 to 65, the timbre combinations that have been once memorized in the timbre table 61 are read out, some processing is performed such as timbre processing, volume change, change of generated sound range and change of outputted sound range, and they are written into the timbre table 61 as new timbre combinations. When the timbre combinations which have once been memorized in the timbre table 61 are read out and the zone select buttons are switched, the same or the processed timbre combinations are written into the timbre group area which is different from the previously memorized timbre group.

(11) Description of the Other Embodiments

The present invention is not limited to the above described embodiments but is allowed to be modified as far as it is not deviated from the purpose of the invention. For instance the step 62, 66 or 67 is able to be eliminated in the above mentioned FIG. 10. Accordingly what are written into the timbre table 61 by operation of the store button 27 are timbre combinations, and a single timbre is not written in.

In FIG. 9 the clearing processing at the step 52, 53 or 54 may be eliminated. Accordingly the zone on/off buttons 25 are functioned at the writing-in/setting status of timbre combinations, the output range/sound generation range can be switched, and sounds are muted (no generation/output).

If the step 54 is eliminated, timbres whose output/generation range is switches or that are muted (no generation/output) are selected and designated by the sound button 22 as well as the setup button 23.

In FIG. 8 the clearing processing at the step 32, 33 or 34 may be eliminated. If the step 32 is eliminated, the zone select buttons 24 are functioned at the reading-out/replaying status of timbre combinations, and it is made possible to process/change each timbre, change volume and change output range or generation range.

If the step 33 is eliminated, timbres that are processed and changed and whose volume, output/generation range are changed are selected and designated by the setup button 23 as well as the sound button 22. If the step 34 is eliminated, such processing is performed commonly to plural timbres of timber combinations as processing/changing each timbre, changing volume, changing output range or generation range, and the changes are not always made individually.

Each timbre of the timbre combinations is selected by the zone select buttons 24 when the timbres are written in/memorized. When the timbres are read out/replayed, they are selected by the zone on/off buttons 25. Therefore the selection of the timbres is made by an operator.

However, the selection of the timbres may be made automatically through a certain processing. For instance upon writing-in/memorizing the timbre combinations, the timbres in the zone "1" or in the first selected zone may be selected and the timbre combinations may be written into the area corresponding to the timbre group that the timbres belong to.

Upon reading-out/replaying the timbre combinations, all the timbres of the timbre combinations may be selected first, and next the timbres in the zone "1" may be selected and then the timbres of the zone "2" may be selected sequentially.

The number of timbres of the above timbre combination, that is, the number of the zone is not necessarily four, but it may be two, three, five or more. Accordingly the number of the zone select buttons 24, the zone on/off buttons 25 and the zone faders 26 may be two, three, five or more.

The timbres of the above timbre combinations may be the timbres/parts corresponding to MIDI channel(s) sent or received through the MIDI circuit 15 by the multi timbre function. In this situation each of the plural timbres designated by the timbre buttons 21 corresponds to the MIDI channel(s).

(12) The Other Effects of the Present Invention

[1] A method for memorizing timbres comprising: plural timbre selection means for tones to select various timbres that are different from one another and the timbre selection means is classified into timbre groups by a predetermined number of timbres; and wherein timber data selected by each of the plural timbre selection means are classified into said timbre groups and are memorized corresponding to said timbre selection means; upon memorizing plural timbre combinations selected by said timbre selection means, some timbres are selected from the timbre combinations and the selected timbres are stored in said memory means according to said timbre selection means which corresponds to said timbre groups that the selected timbres belong to.

Therefore timbre combinations are classified into timbre groups and are memorized by a group unit, so that the timbre combinations are easily taken out.

[2] A computer program for memorizing timbres having a computer execute processing to select some timbres from the timbre combinations and memorize the selected timbres in the above memory means according to the above timbre selection means which corresponds to the above timbre groups that the selected timbres belong to, upon having the process executed to further memorize the plural timbre combinations selected by the above timbre selection means, further to the plural timbre selection means for tones to select various timbres that are different from one another, classified into timbre groups by a predetermined number of timbres, and the memory means to classify the timbre data selected by each of the plural timbre selection means into the above timbre groups and store them according to the above timbre selection means.

Therefore timbre combinations are classified into timbre groups and are memorized by a group unit, so that the timbre combinations are easily taken out.

[3] A timbre memorizing apparatus comprising: plural timbre selection means for tones to select various timbres that are different from one another, being classified into timbre groups by a predetermined number of timbres; memory means to classify the timber data selected by each of the plural timbre selection means into said timbre groups and memorize them corresponding to said timbre selection means; means to select timbre from the timbre combinations and memorize the selected one timbre or some timbres in said memory means according to said timbre selection means which corresponds to said timbre groups that the selected timbres belong to, upon further memorizing the plural timbre combinations selected by said timbre selection means.

Therefore timbre combinations are classified into timbre groups and are memorized by a group unit, so that the timbre combinations are easily taken out.

[4] A timbre memorizing apparatus according to claim 3 comprising: a means to switch the means to memorize the timbre combinations that each of the above timbre combinations is memorized corresponding to each of the above timbre selection means and the means to memorize various sorts of timbres that each or the above various sorts of timbres are memorized corresponding to each of the above timbre selection means, and wherein: the above timbre selection means are classified into the above timbre groups, and the above various timbres and the timbre combinations are both classified into said timbre groups.

Therefore single tones and timbre combinations are classified/arranged into groups of common timbres, which makes classification/arrangement common to single tones and timbre combinations, so that the classification/arrangement become efficient.

[5] A timbre memorizing apparatus according to claim 3 comprising: a means to appoint a combination by selecting a timbre respectively for the above timbre combination as No. n timbre (n=1, 2, . . . ); and wherein the above timbre combination is memorized in the above memory means so as to correspond to the timbre group which the timbres selected by this means to appoint a combination belong to.

Therefore upon writing-in/memorizing timbre combinations, the timbre groups written-in/memorized are selected optionally from any timbre in the timbre combinations.

[6] A timbre memorizing apparatus according to claim 3 wherein: in the above memorized timbre combinations, some timbres are selected so that tones with said timbres are kept from being generated and the output volume of the rest of the timbres is individually or collectively controlled.

Therefore every timbre in the combination is identified individually, some timbres in the timbre combinations are not generated, and accordingly it is recognized that timbers of the timbre combinations are changed.

[7] A timbre memorizing apparatus according to claim 3 wherein: the ranges of outputted toned with each timbre in the above memorized timbre combinations are individually or collectively appointed, and the ranges are selected to be the appointed ranges or all the ranges of the musical tone apparatus.

Therefore the output range of each timbre in the timbre combination is changed optionally, a timbre and a range of the timbre combination are linked to be changed, the range of each timbre in the timbre combination is made different from one another as well as each timbre of the timbre combinations is changed.

[8] A timbre memorizing apparatus according to claim 3 wherein: each memory address of the above memory means corresponds to the above timbre selection means, the above timbres and/or the above timbre combinations are memorized at the memory address, and the timbres and/or the timbre combinations memorized at the corresponding memory address are read out by operating the above timbre selection means.

Therefore one memorized timbre combination corresponds to one timbre generating way, so that it is made easy to take out the timbre combinations.

[9] A timbre memorizing apparatus according to claim 3 wherein: tones with each timbre in the above timbre combinations are individually assigned to time-sharing manner channels (time-division manner channels), are generated independently and simultaneously and are outputted in groups classified by the ranges of the musical tone apparatus or otherwise are generated simultaneously at one operation of sounding a musical tone apparatus.

Therefore tones with different timbres are outputted/generated in different ranges, or in the same ranges in multiple and parallel.

[10] A timbre memorizing apparatus according to claim 3 wherein: selection of timbres in the above timbre combination is made by the operator who operates the timbre memorizing apparatus, or one of the timbres in the above timbre combination is selected under a predetermined condition.

Therefore an operator is able to select timbre groups to memorize timbre combinations freely or automatically.

[11] A timbre memorizing apparatus according to claim 3 wherein: the above memory means has a memory area divided by the above timbre groups with a remaining portion that is able to memorize the above timbre condition.

Therefore the timbre combinations are able to be written in/memorized/set for any timbre group.

[12] A timbre memorizing apparatus according to claim 3 wherein: the above timbre groups correspond to collective sorts of musical instruments such as keyboard, wind, stringed and percussion instruments, and the above timbres correspond to specific sorts of musical instruments such as a piano, violin, flute and drums, envelope waveforms, frequency components, volume of reverberation or volume of resonance.

Therefore the collective sorts and the specific sorts of musical instruments are classified/arranged in multiple by way of timbres.

The invention claimed is:

1. A method for storing timbres in an apparatus that comprises (i) a plurality of timbre selection means, each timbre selection means allowing selection of a single, different timbre, and (ii) memory means for storing single timbre data which are respectively selected by different ones of said plurality of timbre selection means, such that a plurality of said single timbre data are stored, as a timbre combination, in said memory means in correspondence with one of said timbre selection means, the method comprising:

a first receiving step for receiving a selection of different single timbre data which have been respectively selected by different ones of said plurality of timbre selection means;

a step for storing, as a timbre combination, the different single timbre data which have been respectively selected by different ones of said plurality of timbre selection means, such that the selected different single timbre data are stored as the timbre combination in said memory means in correspondence with one of said timbre selection means;

a step for switching between (i) a first mode in which each of said timbre selection means selects one of said single timbres and (ii) a second mode in which each of said timbre selection means selects one of said stored timbre combinations;

a step for reading said single timbre data corresponding to the one said timbre selection means according to operation of the one said timbre selection means, and generating a single tone corresponding to the read single timbre data, when said first mode is selected by said switching;

a step for reading data of all timbres of one said timbre combination simultaneously according to operation of the one said timbre selection means, and generating tones of the all timbres in the one said timbre combination simultaneously, when said second mode is selected by said switching;

a second receiving step for receiving a selection of a timbre in one of the timbre combinations so that a tone of said timbre selected in the second receiving step is kept from being generated, and only tones of a plurality of timbres not selected in the second receiving step are generated, and an output volume of the plurality of timbres not selected in the second receiving step is individually controlled.

2. A non-transitory computer readable medium storing a program causing a computer to execute a process for storing timbres in an apparatus that comprises (i) a plurality of timbre selection means, each timbre selection means allowing selection of a single, different timbre, and (ii) memory means for storing single timbre data which are respectively selected by different ones of said plurality of timbre selection means, such that a plurality of said single timbre data are stored, as a timbre combination, in said memory means in correspondence with one of said timbre selection means, the process comprising:

receiving, in a first receiving step, a selection of different single timbre data which have been respectively selected by different ones of said plurality of timbre selection means;

storing, as a timbre combination, the different single timbre data which have been respectively selected by different ones of said plurality of timbre selection means, such that the selected different single timbre data are stored as the timbre combination in said memory means in correspondence with one of said timbre selection means;

switching between (i) a first mode in which each of said timbre selection means selects one of said single timbres and (ii) a second mode in which each of said timbre selection means selects one of said stored timbre combinations;

reading said single timbre data corresponding to the one said timbre selection means according to operation of the one said timbre selection means, and generating a single tone corresponding to the read single timbre data, when said first mode is selected by said switching;

reading data of all timbres of one said timbre combination simultaneously according to operation of the one said timbre selection means, and generating tones of the all timbres in the one said timbre combination simultaneously, when said second mode is selected by said switching; and receiving, in a second receiving step, a selection of a timbre in one of the timbre combinations so that a tone of said timbre selected in the second receiving step is kept from being generated, and only tones of a plurality of timbres not selected in the second receiving step are generated, and an output volume of the plurality of timbres not selected in the second receiving step is individually controlled.

3. A timbre storing apparatus comprising:

a plurality of timbre selection means, each timbre selection means allowing selection of a single, different timbre data;

memory means in which are stored, as a timbre combination, the different single timbre data which have been respectively selected by different ones of said plurality of timbre selection means, such that the selected different single timbre data are stored as the timbre combination in said memory means in correspondence with one of said timbre selection means;

first selecting means for selecting one timbre from a previously stored timbre combination and changing one more timbres of said previously stored timbre combination in said memory means in correspondence with one said timbre selection means which corresponds to said selected one timbre;

means for switching between (i) a first mode in which each of said timbre selection means selects one of said single timbres and (ii) a second mode in which each of said timbre selection means selects one of said stored timbre combinations;

means for reading said single timbre data corresponding to the one said timbre selection means according to operation of the one said timbre selection means, and generating a single tone corresponding to the read single timbre data, when said first mode is selected by said switching;

means for reading data of all timbres of one said timbre combination simultaneously according to operating of the one said timbre selection means, tones of the all timbres in the timbre combination being generated simultaneously, when said second mode is selected by said switching; and second selecting means to select a timbre in one of the timbre combinations so that a tone of said timbre selected by the second selecting means is kept from being generated, and only tones of a plurality of timbres not selected by the second selecting means are generated, and an output volume of the plurality of timbres not selected by the second selecting means is individually controlled.

4. The timbre storing apparatus according to claim 3 further comprising:

means to appoint a combination by selecting a timbre respectively for said timbre combination as No. n timbre (n=1, 2, . . . ); and wherein said timbre combination is memorized in said memory means so as to correspond to a timbre group which the timbres selected by said means to appoint belong to.

5. The timbre storing apparatus according to claim 4, further comprising:

means to individually or collectively appoint ranges of outputted tones with each timbre in said memorized timbre combinations, wherein the ranges are selected to be appointed ranges or all ranges of the timbre memorizing apparatus.

6. The timbre storing apparatus according to claim 5 wherein:

the memory means includes different memory addresses corresponding to a respective timbre selection means, said timbres and/or said timbre combinations are memorized at a memory address, and the timbres and/or the timbre combinations memorized at the corresponding memory address are read out by operating said timbre selection means.

7. The timbre storing apparatus according to claim 6 wherein:

tones with each timbre in said timbre combinations are individually assigned to time-sharing manner channels or time-division manner channels, are generated independently and simultaneously and are outputted in groups classified according to musical tone apparatus, or otherwise are generated simultaneously at one operation of sounding a musical tone apparatus.

8. The timbre storing apparatus according to claim 7 wherein:

said memory means has a memory area divided according to said classified groups, with a remaining portion that is able to store a timbre condition.

9. The timbre storing apparatus according to claim 8 wherein:

said classified groups correspond to collective sorts of musical instruments including keyboard, wind, stringed and percussion instruments, and said timbres correspond to specific sorts of musical instruments including a piano, violin, flute and drums, envelope waveforms, frequency components, volume of reverberation or volume of resonance.

* * * * *